US006270315B1

(12) United States Patent
Greim et al.

(10) Patent No.: US 6,270,315 B1
(45) Date of Patent: Aug. 7, 2001

(54) HIGHLY LOADED TURBINE BLADING

(75) Inventors: Ralf Greim, Bimenstorf; Said Havakechian, Baden, both of (CH); Harald Romer, Waldshut (DE); Peter Szincsak, Nussbaumen (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/395,562

(22) Filed: Sep. 14, 1999

(30) Foreign Application Priority Data

Sep. 29, 1998 (EP) ..... 98810980

(51) Int. Cl.[7] ..... F01D 9/00

(52) U.S. Cl. ..... 415/199.5; 415/193; 416/DIG. 2; 416/DIG. 5

(58) Field of Search ..... 415/199.5, 199.4, 415/193, 194, 191; 416/DIG. 2, DIG. 5, 198 A, 201 R, 203

(56) References Cited

U.S. PATENT DOCUMENTS 4,274,261 6/1981 Horgan .
4,403,915 * 9/1983 Teufelberger ..... 415/199.5
4,778,335 * 10/1988 Nishioka ..... 415/191
5,342,170 * 8/1994 Elvekjaer et al. ..... 415/191
5,554,000 * 9/1996 Katoh et al. ..... 415/191
5,611,389 3/1997 Alessandri et al. .

FOREIGN PATENT DOCUMENTS

0786580A2 7/1997 (EP) .

* cited by examiner

*Primary Examiner*—Edward K. Look
*Assistant Examiner*—Richard Woo
(74) *Attorney, Agent, or Firm*—Burns, Doane, Swecker & Mathis, L.L.P.

(57) ABSTRACT

To reduce the number of stages of a turbine and, associated therewith, the overall length and the costs, blading having high stage-specific enthalpy transfer is to be used. In this case, the disadvantages of conventional highly loaded blading, such as increased secondary flow losses due to blades of large chord length and comparatively small height and the design of the turbine in the complicated chamber type of construction, are to be avoided. Resulting from these requirements is a highly loaded slim blade type of construction having considerable deflection. A turbine having blading according to the invention is characterized by a loading parameter RBL, which in the HRBL blading according to the invention, in contrast to conventional types of construction, is greater than 1.

4 Claims, 3 Drawing Sheets

HIGHLY LOADED TURBINE BLADING

BACKGROUND OF THE INVENTION

1. Field of the Invention

The invention relates to a turbine.

2. Discussion of Background

In the design of axial-flow stages of turbines, two approaches are essentially followed nowadays. Thus, on the one hand, at high work transfer in the stage, a large chord length of the blades and a large hub-section diameter are selected, with at the same time a small blade height. However, this design is inconsistent with the fluid-mechanical knowledge that, in order to reduce leakage losses and wall-friction losses, the blade height selected should be large, with at the same time a small hub diameter, and furthermore that the secondary flow losses increase drastically at a small ratio of blade height to chord length.

In this arrangement of the blades on large hub diameters, the turbine is usually of a chamber type of construction in order to limit the gap losses at the blade tips in the case of the small blade height. As a result, however, the wheel-friction losses greatly increase. Furthermore, the chamber type of construction is very costly. On the other hand, large hub diameters can scarcely be avoided especially in impulse turbines, since otherwise the deflection in the vicinity of the hub increases in such a way that the flow would separate and generate inexcusable losses.

Therefore a further approach selected is to keep the work transfer relatively low and to place large blade lengths on small diameters, the blades being given a small chord length at smaller flow deflection. Due to the substantially smaller hub diameter, the drum type of construction, which is far more cost-effective, may be used. However, a large number of stages result for a machine having given inlet and outlet states of the working medium. This will in turn force the overall length of a machine to be increased, which on the one hand has an adverse effect on the rotor dynamics; on the other hand, the advantage of the lower losses of an individual blade cascade will also be at least partly neutralized again by the large number of stages required. In addition, a type of construction with a large number of stages again pushes the costs up.

For the reasons cited, both design variants are usually combined in steam turbo sets actually constructed. For example, the use of one or more stages of low reaction and with high work transfer at maximum pressures and slightly loaded repeat stages of high reaction in the further course of the expansion of the working medium is widespread. A high pressure in the first stages is rapidly reduced by this type of construction without transmitting significant axial thrust to the rotor, a smaller length of the rotor being necessary for a certain degree of expansion. In this case, for reasons of, in particular, aerodynamic loading, a large chord length of the blades is selected in order not to allow the flow deflection required for achieving the high work transfer to become too extreme. Likewise, the blades are placed on large diameters in order to limit the deflection in the hub section. The further reduction in enthalpy is then effected in stages of high reaction.

Thus the advantages, but also in particular the disadvantages, of both types of construction are combined in modern conventional machines actually constructed. Blading which combines the features of the design variants in such a way that their advantages come to bear without restriction has not been known in technology up to now.

SUMMARY OF THE INVENTION

Accordingly, one object of the invention, in a heat engine of the type mentioned at the beginning, is to provide novel blading which combines a high stage enthalpy transfer with low losses.

The essence of the invention, in an essentially axial-flow turbine, is therefore to design the blading in such a way that, at a predetermined mass flow and predetermined inlet and outlet states of the working medium, as small a number of stages as possible are required and the enthalpy transfer takes place with low losses. To this end, considerable flow deflection is provided, and at the same time the chord length of the blades is kept small. Furthermore, blades of large height are selected and are placed on a large diameter. It is readily apparent to the person skilled in the art that these variables, when evaluating the degree to which the object is fulfilled, are in a very complex relationship with one another, so that the simple specification of geometric characteristic factors taken by itself is unsuitable for characterizing the blading according to the invention. Therefore the features of the subject matter of the invention are applied to a dimensionless characteristic factor to be explained below and called RSH to begin with. Advantageous developments and uses follow from the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a so-called HRBL turbine (high relative blade-loading level), wherein.

DESCRIPTION OF THE PREFERRED EMBODIMENTS

Figure 1:
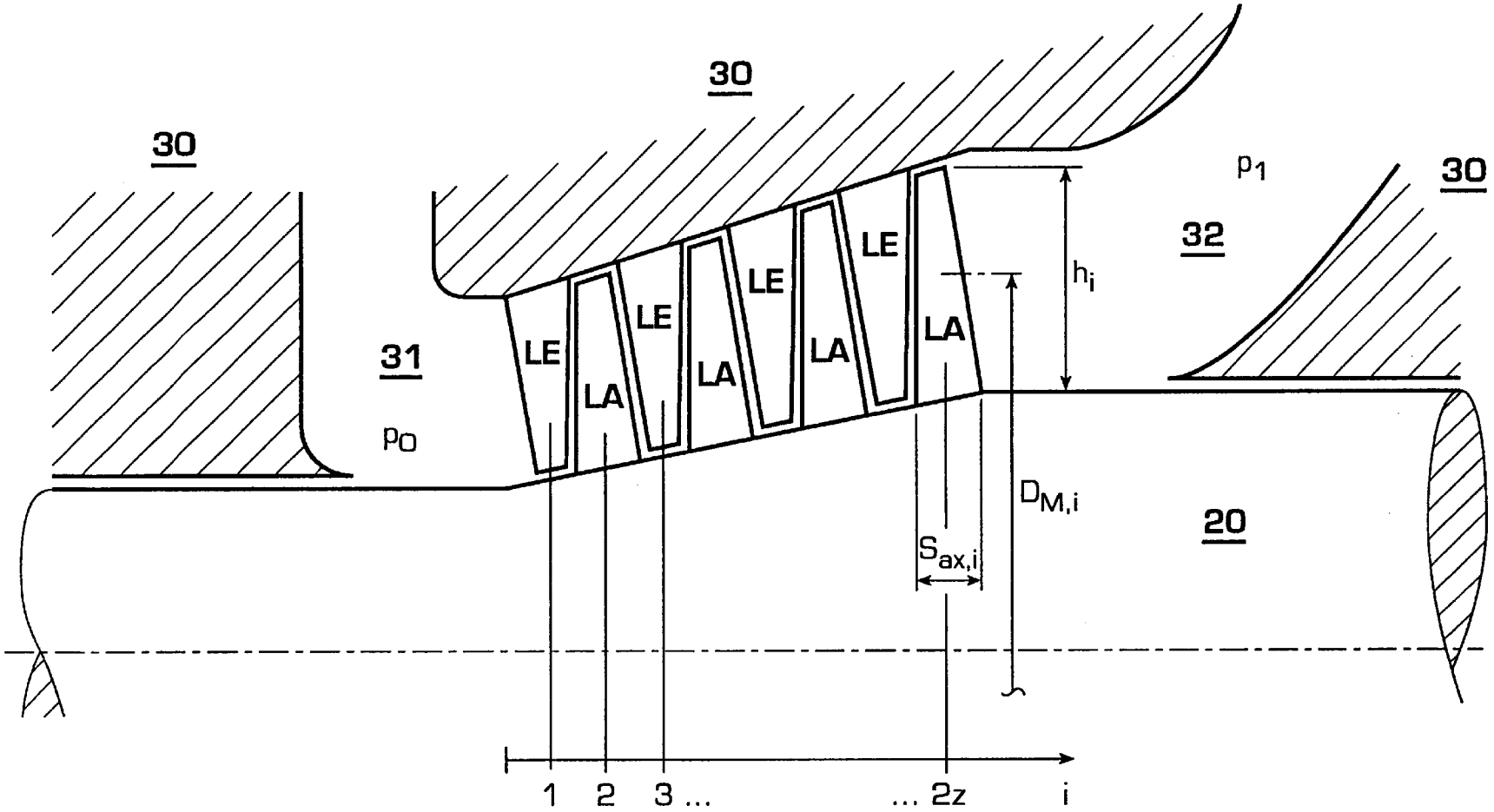
FIG. 1 shows by way of example a turbine having four axial-flow stages and explains the geometric variables which are decisive for forming the loading parameter RBL.

Referring now to the drawings, wherein like reference numerals designate identical or corresponding parts throughout the several views, FIG. 1 shows a turbine having four stages, the moving blades LA of which are fastened to a shaft 20 and the guide blades LE of which are fastened in a casing 30. The stages are arranged between an inflow section 31 and an outflow section 32, in which the pressures $p_0$ and $P_1$ respectively prevail. The blade rows are numbered from the inflow section 31 to the outflow section 32 of the casing 30; if z is the number of stages, there are 2z blade rows, that is, in the example shown with four stages, eight blade rows. Furthermore, geometric variables relevant to the invention can be seen from FIG. 1. These are the blade height h, the mean section diameter $D_M$ and the axial chord length sax of a blade.

The single-flow turbine shown here is on no account to be understood in a restrictive sense; in particular, the turbine could also be part of a large steam turbo set. Likewise, a plurality of turbines could also be accommodated with separate or common inflow and outflow sections in one casing.

Of course, as mentioned above, the flow deflection in the blade ducts is also of great importance when evaluating turbine blading according to the invention; however, this may first of all be expressed in a completely equivalent manner via its mass-flow-specific and rotational-speed-specific enthalpy transfer or, in the case of a predetermined machine, also by a stage-specific and mass-flow-specific output, as is readily apparent to the person skilled in the art.

To compare the blades of different turbines or stages, a characteristic factor which enables such blades in machines of different output and mass-flow classes and at different pressure levels to be characterized is now necessary. Furthermore, in the optimization task described above, blade-loading and blade-loss parameters must be appropriately correlated.

An essentially axial-flow stage or turbine is described with regard to the invention essentially by the following variables:

Output P

Rotational speed N

Number of stages z

Pressure p

Mass flow m

Blade height h

Axial chord length $s_{ax}$

Mean section diameter $D_m$, defined as the mean value of casing inside diameter and hub outside diameter These dimensional variables are first of all to be rendered dimensionless in an appropriate manner.

Here, first of all the specific output is treated as blade-loading parameter. The output of a turbomachine is proportional to the mass flow and the square of the rotational speed. Obtained for the dimensionless stage-specific output is thus the relationship $$P' \propto \frac{P}{z \cdot \dot{m} \cdot N^2 \cdot L^2}$$

where L is a characteristic length scale of one or more turbine stages or of a turbine. Here, the stage kinematics suggest that the mean section diameter be selected as characteristic length scale; the dimensionless specific output thus becomes $$P' = \frac{P}{z \cdot \dot{m} \cdot N^2 \cdot D_M^2}$$

The mean pressure level is to be designated as a further characteristic variable, and this mean pressure level is now likewise to be converted into a dimensionless loading parameter. In this case, physical knowledge teaches that, in particular, the pressure gradient over a blade row or stage constitutes a significant influencing variable in the present connection. Thus for the pressure $$p' \propto \frac{p}{z}\left[\frac{\mathrm{kg}}{\mathrm{s}^2 \cdot \mathrm{m}}\right]$$

is obtained.

The dimension depicted shows which variables are still necessary in order to render the pressure dimensionless. These are a characteristic mass, a time scale and a length scale. Therefore the mass flow and the rotational speed are used here in order to render the variable dimensionless with regard to mass and time. Furthermore, physical knowledge shows that, with the aim of forming a loading parameter, a lever via which the pressure forces act on the blade is to be selected as length scale. Ultimately, the dimensionless pressure gradient thus becomes $$p' = \frac{p}{z \cdot \dot{m} \cdot N} \cdot h$$

An aspect forming the fundamental basis of the invention is the minimization of the secondary flow losses, which to a considerable degree are determined by the ratio of the blade height to the axial chord length. Therefore the geometric characteristic $$h' = \frac{h}{s_{ax}}$$

must also be taken into account, and this geometric characteristic may also be regarded as a characteristic for the secondary losses.

As mentioned above, the increase in the stage loading and the reduction associated therewith in the number of stages is not an end in itself; on the other hand, the rotor vibrations become easier to control by a reduction in the rotor length. In this case, the vibration behavior is substantially dependent on the ratio of the rotor mass and bending length, substantially reproduced by $z.s_{ax}$, and on the planar moment of inertia of the rotor, at otherwise given geometry, substantially characterized by $D_m^2$. Thus a dimensionless variable which describes the rotor vibration behavior is defined:

$$S' = \frac{D_M^2}{(z \cdot s_{ax})^2}$$

S' reproduces in a certain manner the rigidity of the rotor.

To identify the turbine blades according to the invention having high cascade loading and low losses, with at the same time favorable resulting rotor vibration behavior, the variable RBL (relative blade-loading level) is thus formed as $$\mathrm{RBL} = \mathrm{K} \cdot \mathrm{P}'^{A} \cdot \mathrm{p}'^{B} \cdot \mathrm{h}'^{C} \cdot \mathrm{S}'^{D}$$

from the dimensionless loading, loss and vibration characteristics. K is a constant with which RBL is to be adapted to an appropriate order of magnitude.

The exponents A, B, C and D are now to be selected in such a way that the parameter RBL, in the best possible manner, characterizes blading according to the invention having high stage enthalpy transfer and low secondary flow losses, due to a high ratio of blade height to chord length. Thus $$\mathrm{RBL} = \mathrm{K} \cdot \mathrm{P}'^{2} \cdot \mathrm{p}'^{4} \cdot \mathrm{h}'^{4} \cdot \mathrm{S}'$$

is chosen.

This selection of the exponents is made in order to assign a high weighting to considerable circumferential work with at the same time a high ratio of blade height to chord length, which of course is the essence of the invention. Expressed in the dimensional basic variables, RBL results as $$RBL = 1.1 \cdot \pi \cdot 10^{-15} \cdot \frac{P^2 \cdot \overline{p}^4}{z^8 \cdot m^6 \cdot N^8} \cdot \sum_{i=1}^{2 \cdot z} \frac{h_i^8}{D_{M,i}^2 \cdot s_{ax,i}^6}$$

For the characterization of a turbine, in which of course the pressure as well as the geometrical data vary greatly, the following is taken as a basis according to the invention $$RBL = 1.1 \cdot \pi \cdot 10^{-15} \cdot \frac{P^2 \cdot \overline{p}^4}{z^8 \cdot \dot{m}^6 \cdot N^8} \cdot \sum_{i=1}^{2 \cdot z} \frac{h_i^8}{D_{M,i}^2 \cdot s_{ax,i}^6}$$

where $\overline{p}$ is the arithmetic mean of inlet pressure and outlet pressure, and the geometric data are added up over all the blade rows. In this case, the mean section diameter and the blade height are each determined on the outflow side of a blade, whereas for the axial chord length in each case the value of the maximum profile chord length is used. With the constant preliminary factor selected, RBL, with the use of SI base units, is in the order of magnitude of 1.

The evaluation of the blading of a machine by means of the characteristic factor RBL may be appropriately carried out for every essentially axial-flow turbine. In this case, the turbine is defined as all the blades arranged alternately as guide rows and moving rows in a common casing between an inflow section and an outflow section; the turbine may therefore also easily be a turbine section of a steam turbo set, such as, for example, the intermediate-pressure turbine of a triple-pressure plant.

Figure 2:
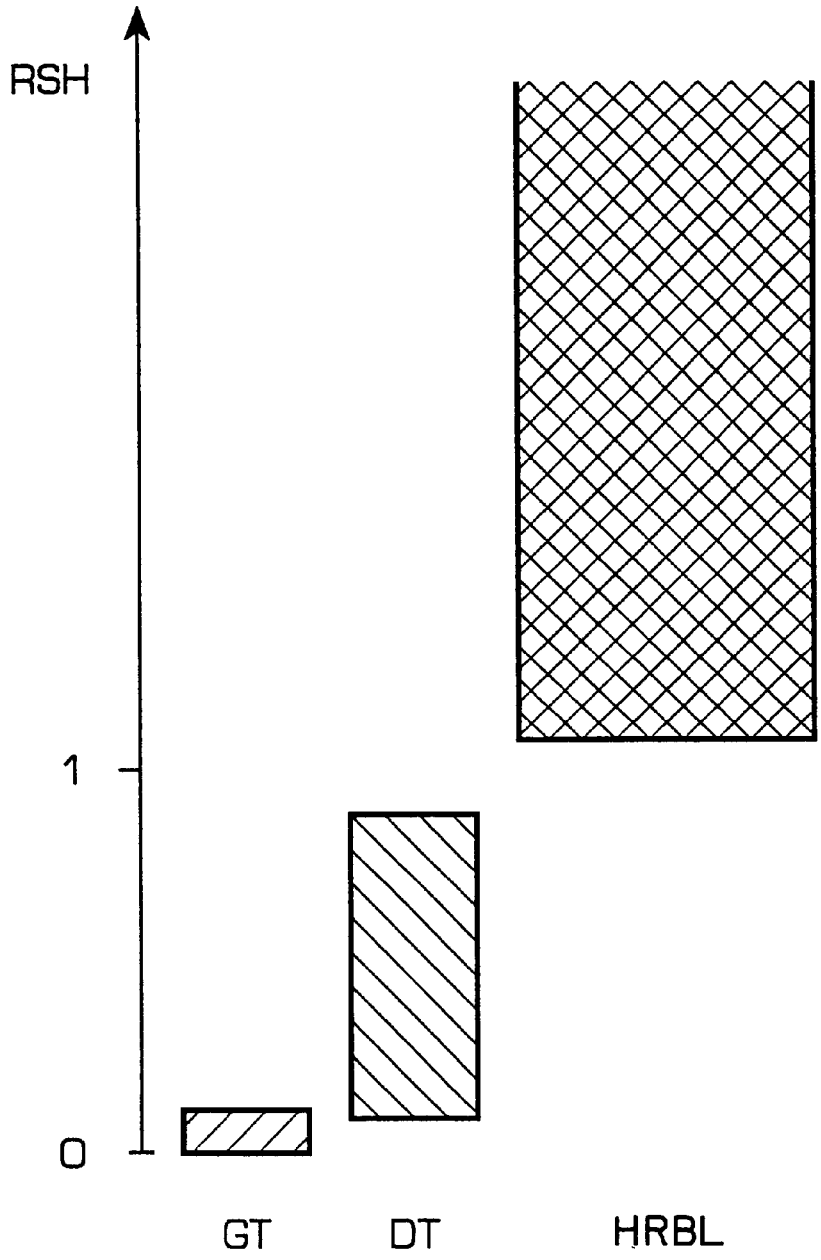
FIG. 2 characterizes different machine types with reference to typical RBL ranges.

FIG. 2 shows the RBL ranges within which turbines of modern conventional construction typically lie. The RBL range within which modern gas turbines typically work is identified by GT and is less than 0.1. Steam turbines which have been constructed are to be found within the range of about 0.1 to 0.7, identified by DT. The design of a turbine with highly loaded HRBL blading according to the invention leads to an RBL which is greater than 1.

The essence of the invention, with predetermined thermodynamic data at the turbine inlet and outlet and predetermined output, mass flow and rotational speed, may thus be seen in designing the blade geometry in such a way that the RBL of the turbine is greater than 1. In contrast to turbines constructed up to now, this requires the use of long slim blades with at the same time considerable deflection.

The essential advantages of the invention may be seen in the fact that the number of stages and thus the overall length, at the same mass-flow-specific output and predetermined pressure level, are markedly reduced compared with conventional types of construction. Due to the large blade heights, according to the invention even in the case of a low degree of reaction, on a comparatively small hub diameter, the low-loss and cost-effective drum type of construction can be retained when using the blading according to the invention, even during the transition to high stage enthalpy transfers. In addition, due to the high ratio of blade height to axial chord length, the secondary flow losses, which greatly increase in a conventional blade design with the enthalpy transfer, are kept within limits.

However, reference may also be made to the fact that, during the use of the HRBL blading according to the invention, the mechanical as well as the aerodynamic loading of the blades is pushed to the admissible limits to an extent not yet realized hitherto, so that the tolerance range provided in which a faulty design remains without harmful consequences is very restricted. As can be seen from the calculation specification for RBL, very slim blades having a high deflection over a short axial flow path must be realized. The blading according to the invention therefore calls for the currently highest and until quite recently inconceivable standards in the design, in particular in the calculation of the mechanical blade loading and the aerodynamic blade loading, if it is to be used successfully.

Figure 3B:
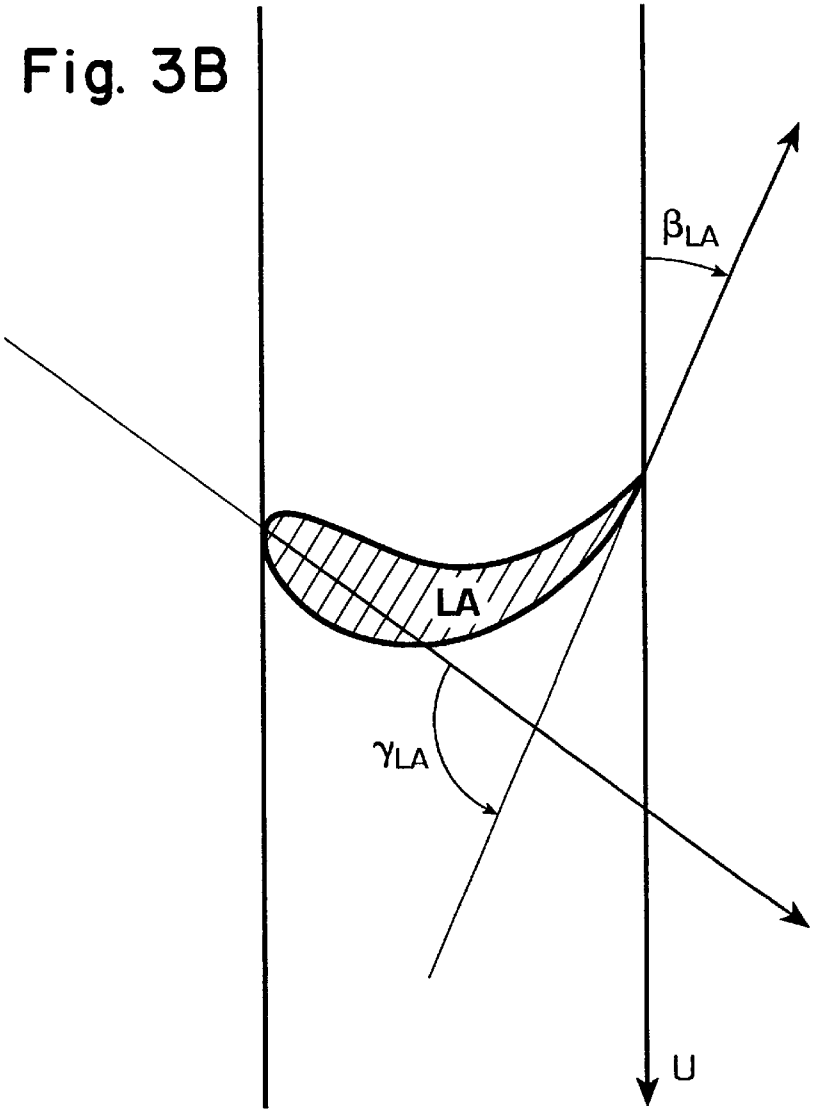
FIG. 3 illustrates by way of example the deflection and outflow angles of a guide blade and a moving blade.
Figure 3A:
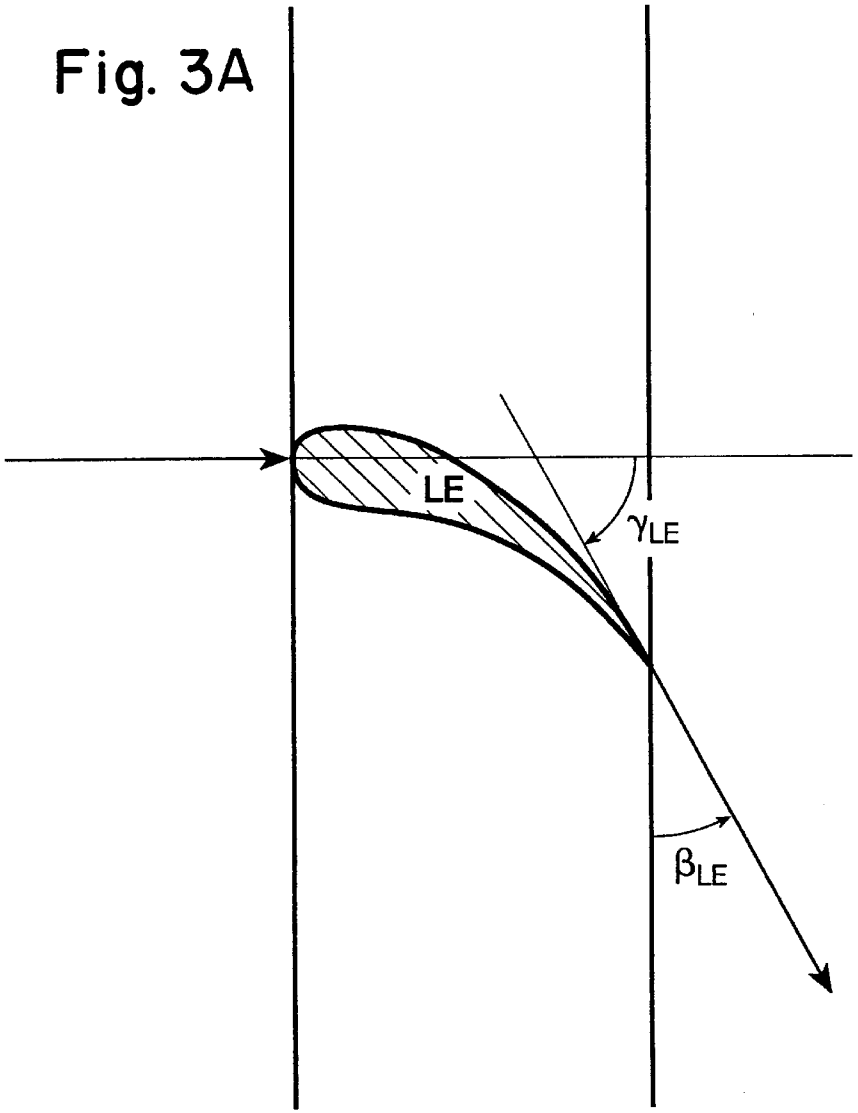

FIG. 3 shows the plan view of a guide blade and a moving blade in the hub section. In the design of blading according to the invention, the outflow angle β relative to the circumferential direction U, despite the large flow deflection γ desired, is advantageously kept greater than 8°, which applies to both the outflow angle of a guide blade $\beta_{LE}$ and the outflow angle of a moving blade $\beta_{LA}$. This is advantageous, on the one hand, in order to limit the swirl of the cascade outflow and, on the other hand, in order to also obtain no excessive obstruction of the flow ducts. Furthermore, it is of advantage in the blade design to limit the maximum deflection $\gamma_{LE}$ and $\gamma_{LA}$ of a guide blade and moving blade respectively in the hub section to in each case less than 150° in order to avoid flow separations, which generate considerable losses, in this region.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A turbine having at least one essentially axial-flow stage, which stage consists of a guide-blade row (LE) and a moving-blade row (LA), which are accommodated in a common casing (30) , which casing has at least one inflow section (31) and at least one outflow section (32), and furthermore the degree of reaction of a stage being greater than 0.15, wherein, for a turbine part which lies between an inflow section (31) and an outflow section (32) of the casing (30), for the essentially axial-flow blade rows (LE, LA), the ratio of their axial chord length ($s_{ax}$) to their height (h) is selected in such a way that a characteristic factor RBL is greater than 1, RBL being defined by $$RBL = 1.1 \cdot \pi \cdot 10^{-15} \cdot \frac{P^2 \cdot \overline{p}^4}{z^8 \cdot \dot{m}^6 \cdot N^8} \cdot \sum_{i=1}^{2 \cdot z} \frac{h_i^8}{D_{M,i}^2 \cdot s_{ax,i}^6}$$

in which calculation specification p [W]=output of the turbine $\overline{p}$ [Pa]=arithmetic mean between inlet pressure and outlet pressure of the turbine z [-]=number of stages $\dot{m}$ [kg/s]=mass flow of the working medium which flows through the turbine N [1/s]=rotational speed $h_i$ [m]=blade height of a blade of the blade row i, measured on the outflow side of the blade $D_{m,i}$ [m]=mean value of hub outside diameter and casing inside diameter, measured on the outflow side of a blade of the blade row i $S_{ax,i}$ [m]=axial chord length of a blade of the blade row i, measured at the point of maximum axial chord length.

2. The turbine as claimed in claim 1, wherein an outflow angle ($\beta_{LE}$, $\beta_{LA}$) of each blade relative to a circumferential direction (U) is greater than 8°.

3. The turbine as claimed in claim 1, wherein the turbine is of a drum type of construction.

4. The turbine as claimed in claim 1, wherein a maximum flow deflection ($\gamma_{LE}$, $\gamma_{LA}$) in the hub section of each blade row is less than 150°.

* * * * *